US011629913B2

(12) United States Patent
Kromer et al.

(10) Patent No.: US 11,629,913 B2
(45) Date of Patent: Apr. 18, 2023

(54) INTEGRATED NITROGEN LIQUEFIER FOR A NITROGEN AND ARGON PRODUCING CRYOGENIC AIR SEPARATION UNIT

(71) Applicants: Brian R. Kromer, Buffalo, NY (US); Neil M. Prosser, Lockport, NY (US); Jeremy M. Cabral, Clarence Center, NY (US); James R. Handley, East Amherst, NY (US)

(72) Inventors: Brian R. Kromer, Buffalo, NY (US); Neil M. Prosser, Lockport, NY (US); Jeremy M. Cabral, Clarence Center, NY (US); James R. Handley, East Amherst, NY (US)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 179 days.

(21) Appl. No.: 17/241,218

(22) Filed: Apr. 27, 2021

(65) Prior Publication Data

US 2021/0356206 A1 Nov. 18, 2021

Related U.S. Application Data

(60) Provisional application No. 63/025,358, filed on May 15, 2020.

(51) Int. Cl.
*F25J 3/04* (2006.01)

(52) U.S. Cl.
CPC ..... *F25J 3/04412* (2013.01); *F25J 3/04084* (2013.01); *F25J 3/04096* (2013.01);
(Continued)

(58) Field of Classification Search
CPC .. F25J 3/04412; F25J 3/04084; F25J 3/04096; F25J 3/04181; F25J 3/04187;
(Continued)

(56) References Cited

U.S. PATENT DOCUMENTS 4,575,388 A 3/1986 Okada
4,822,395 A 4/1989 Cheung
(Continued)

FOREIGN PATENT DOCUMENTS

CN 106642995 B 5/2019
DE 19855485 A1 6/1999
(Continued)

OTHER PUBLICATIONS

Harry Cheung; "Moderate-pressure cryogenic air separation process"; Gas Separation & Purification; Mar. 1991; vol. 5; pp. 25-28.
(Continued)

*Primary Examiner* — Miguel A Diaz
*Assistant Examiner* — Ibrahim A. Michael Adeniji
(74) *Attorney, Agent, or Firm* — Robert J. Hampsch

(57) ABSTRACT

A nitrogen liquefier configured to be integrated with an argon and nitrogen producing cryogenic air separation unit and method of nitrogen liquefaction are provided. The integrated nitrogen liquefier and associated methods may be operated in at least three distinct modes including: (i) a nil liquid nitrogen mode; (ii) a low liquid nitrogen mode; and (iii) a high liquid nitrogen mode. The present systems and methods are further characterized in an oxygen enriched stream from the lower pressure column of the air separation unit is an oxygen enriched condensing medium used in the argon condenser.

12 Claims, 2 Drawing Sheets

(52) U.S. Cl.
CPC ..... *F25J 3/04181* (2013.01); *F25J 3/04187* (2013.01); *F25J 3/04036* (2013.01)

(58) Field of Classification Search
CPC .. F25J 3/04036; F25J 2200/94; F25J 3/04212; F25J 2230/52; F25J 3/0426; F25J 3/04496; F25J 2200/20; F25J 2205/60; F25J 2210/42; F25J 2230/42; F25J 2250/04; F25J 3/04296; F25J 2235/50; F25J 2245/42; F25J 2245/50; F25J 3/04303; F25J 3/04357; F25J 3/04393; F25J 3/04672; F25J 3/04727; F25J 3/0486; F25J 3/0409; F25J 3/04848; F25J 3/04812
See application file for complete search history.

(56) References Cited

U.S. PATENT DOCUMENTS

| | | | |
|---|---|---|---|
| 5,069,698 | A | 12/1991 | Cheung |
| 5,255,522 | A | 10/1993 | Agrawal et al. |
| 5,305,611 | A | 4/1994 | Howard |
| 5,355,681 | A | 10/1994 | Xu |
| 5,440,884 | A | 8/1995 | Bonaquist |
| 5,469,710 | A | 11/1995 | Howard |
| 5,722,259 | A | 3/1998 | Sorensen |
| 5,802,873 | A | 9/1998 | Howard |
| 5,956,973 | A | 9/1999 | Herron |
| 6,106,593 | A | 8/2000 | Golden et al. |
| 6,173,586 | B1 | 1/2001 | Bonaquist |
| 6,397,632 | B1 | 6/2002 | Meagher |
| 6,694,775 | B1 | 2/2004 | Higginbotham et al. |
| 10,663,222 | B2 | 5/2020 | Kromer et al. |
| 10,663,223 | B2 | 5/2020 | Handley et al. |
| 10,663,224 | B2 | 5/2020 | Prosser et al. |
| 10,816,263 | B2 | 10/2020 | Prosser et al. |
| 2005/0138960 | A1* | 6/2005 | Prosser ..... F25J 3/04393 62/643 |
| 2007/0209389 | A1 | 9/2007 | Prosser |
| 2008/0000352 | A1 | 1/2008 | Howard |
| 2008/0223077 | A1 | 9/2008 | Prosser |
| 2009/0277220 | A1 | 11/2009 | Howard |
| 2010/0037656 | A1 | 2/2010 | Prosser |
| 2012/0011887 | A1 | 1/2012 | Nakamura et al. |
| 2012/0036892 | A1 | 2/2012 | Prosser |
| 2013/0312427 | A1 | 11/2013 | Hashi et al. |
| 2014/0245782 | A1 | 9/2014 | Howard |
| 2016/0025408 | A1 | 1/2016 | Xu |
| 2017/0030638 | A1 | 2/2017 | Prosser et al. |
| 2017/0030640 | A1 | 2/2017 | Du et al. |
| 2017/0167788 | A1 | 6/2017 | Pierre, Jr. |
| 2018/0073804 | A1 | 3/2018 | Allam |
| 2019/0331416 | A1 | 10/2019 | Prosser et al. |
| 2019/0331418 | A1 | 10/2019 | Prosser et al. |
| 2020/0054985 | A1* | 2/2020 | Parsnick ..... F25J 3/04212 |

FOREIGN PATENT DOCUMENTS

| | | | |
|---|---|---|---|
| DE | 10232430 | A1 | 1/2004 |
| DE | 20319823 | U1 | 4/2004 |
| EP | 0454327 | A1 | 10/1991 |
| EP | 0576314 | A1 | 12/1993 |
| JP | S54116385 | A | 9/1979 |
| JP | S6179978 | A | 4/1986 |
| JP | S61243273 | A | 10/1986 |
| WO | 87/006684 | A1 | 11/1987 |
| WO | 2013/167817 | A2 | 11/2013 |

OTHER PUBLICATIONS

Roland Michely; "Luftzerlegungsanlagen im Parallelbetrieb", Linde Berichte Aus Technik & Wissenschaft, No. 43, Jun. 1, 1978 (Jun. 1, 1978), pp. 39-44, XP001253417, p. 41, col. 2, paragraph 3; figures 2-4, p. 43, col. 2, lines 3-5.

H. Springmann; "Moeglichkeiten zur Energieeinsparung", Linde-Symposium, Luftzerlegungsanlagen, Oct. 15, 1980 (Oct. 15, 1980), pp. 1-16, XP055392504, p. 14, paragraph 2-p. 15, paragraph 1; figure 12.

Hashimoto Tamotsu; "New air separation plant utilizing off peak power", Kobelco Technology Review, Kobe Steel, Kobe, JP, No. 15, Oct. 1, 1992 (Oct. 1, 1992), p. 71, XP009187816, ISSN: 0913-4794, paragraph [0001]-paragraph [0003]; figure 1; table 1.

* cited by examiner

INTEGRATED NITROGEN LIQUEFIER FOR A NITROGEN AND ARGON PRODUCING CRYOGENIC AIR SEPARATION UNIT

CROSS REFERENCE TO RELATED APPLICATIONS

This application claims the benefit of and priority to U.S. provisional patent application Ser. No. 63/025,358 filed May 15, 2020 the disclosure of which is incorporated by reference.

TECHNICAL FIELD

The present invention relates to the enhanced recovery of liquid nitrogen from a nitrogen and argon producing cryogenic air separation unit, and more particularly, to an integrated nitrogen liquefier capable of operating in a no liquid nitrogen mode, a low liquid nitrogen mode and a high liquid nitrogen mode.

BACKGROUND

Industrial gas customers in the electronics industry often seek argon and nitrogen product slates at volumes and pressure that are typically produced from a cryogenic air separation unit as disclosed in the technical publication *Cheung, Moderate Pressure Cryogenic Air Separation Process, Gas Separation & Purification, Vol* 5, *March* 1991 and U.S. Pat. No. 4,822,395 (Cheung). Similarly, U.S. patent application Ser. Nos. 15/962205; 15/962245; 15/962297; and 15/962358 filed on Apr. 25, 2018 as well as U.S. patent application Ser. No. 16/662193 filed on Oct. 24, 2019, the disclosures of which are incorporated by reference herein, disclose new air separation cycles that represent improvements over the system disclosed by Cheung. Such improvements to moderate pressure argon and nitrogen producing air separation units use an oxygen enriched stream taken from the lower pressure column as the condensing medium in the argon condenser to condense the argon-rich stream thus improving argon and nitrogen recoveries. However, these novel air separation cycles are typically gas only plants that may be operationally limited in cryogenic air separation applications requiring significant liquid nitrogen production as well as cryogenic air separation applications requiring variable liquid nitrogen production.

While many of electronics industry applications are focused on gas only air separation unit designs, some customers seek further product requirements that may include some oxygen production (in liquid and/or gaseous form) as well as liquid nitrogen backup. Such additional product requirements have traditionally been met using secondary sources of oxygen and liquid nitrogen.

What is needed is a cryogenic air separation plant that is capable of providing the base argon and nitrogen products as well as the oxygen and liquid nitrogen products. Such air separation unit should preferably have the flexibility to operate in an argon and nitrogen gas only mode and in one or more liquid nitrogen modes, including a high liquid nitrogen mode, at liquid make rates of up to about 10% of the incoming air. In other words, further improvements to the argon and nitrogen producing moderate pressure cryogenic air separation units and cycles are needed to efficiently produce variable amounts of liquid nitrogen while maintaining overall high nitrogen recovery and high argon recoveries from the distillation column system within the cold box of the cryogenic air separation unit.

SUMMARY OF THE INVENTION

The present invention may be characterized as an air separation unit comprising: (i) a main air compression system configured for receiving a stream of incoming feed air and producing a compressed air stream; (ii) an adsorption based pre-purifier unit configured for removing water vapor, carbon dioxide, nitrous oxide, and hydrocarbons from the compressed air stream and producing a compressed and purified air stream; (iii) a main heat exchange system configured to cool the compressed and purified air stream to temperatures suitable for fractional distillation; (iv) a distillation column system having a higher pressure column and a lower pressure column linked in a heat transfer relationship via a condenser-reboiler, the distillation column system further includes an argon column arrangement operatively coupled with the lower pressure column, the argon column arrangement having at least one argon column and an argon condenser, the distillation column system configured for receiving the cooled, compressed and purified air stream and produce at least two or more oxygen enriched streams from the lower pressure column; an argon product stream, a gaseous nitrogen product stream; and (v) a nitrogen liquefier comprising a nitrogen feed compressor; a nitrogen recycle compressor; a warm booster compressor, a booster loaded warm turbine, a cold booster compressor, and a booster loaded cold turbine and integrated with the main heat exchange system and distillation column system and wherein the nitrogen liquefier is arranged or configured to receive a portion of the gaseous nitrogen product stream and produce a liquid nitrogen product stream.

Alternatively, the present invention may be characterized as a method of separating air comprising the steps of: (a) compressing a stream of incoming feed air in a main air compression system to produce a compressed air stream; (b) purifying the compressed air stream in an adsorption based pre-purifier unit to produce a compressed and purified air stream; (c) cooling the compressed and purified air stream in a main heat exchange system to temperatures suitable for fractional distillation; (d) fractionally distilling the cooled, compressed and purified air stream in a distillation column system having a higher pressure column and a lower pressure column linked in a heat transfer relationship via a condenser-reboiler, the distillation column system further comprising an argon column arrangement operatively coupled with the lower pressure column, the argon column arrangement having at least one argon column and an argon condenser, the distillation column system configured to produce at least two or more oxygen enriched streams from the lower pressure column; an argon product stream, a gaseous nitrogen product stream; and (e) liquefying a portion of the gaseous nitrogen product stream in a nitrogen liquefier, the nitrogen liquefier comprising a nitrogen feed compressor; a nitrogen recycle compressor; a warm booster compressor, a booster loaded warm turbine, a cold booster compressor, and a booster loaded cold turbine and integrated with the main heat exchange system and distillation column system and wherein the nitrogen liquefier is arranged or configured to receive a portion of the gaseous nitrogen product stream and produce a liquid nitrogen product stream.

In both the system and method, the nitrogen liquefier is configured to operate in three modes, including: (1) a nil liquid nitrogen mode where no portion of the gaseous nitrogen product stream is diverted to the nitrogen liquefier and no liquid nitrogen product stream is produced in the nitrogen liquefier; (2) a low liquid nitrogen mode wherein the gaseous nitrogen feed stream bypasses the nitrogen feed compressor and is diverted to the nitrogen recycle compressor; and (3) a high liquid nitrogen mode wherein the gaseous nitrogen feed stream is directed to the nitrogen feed compressor of the nitrogen liquefier. The present systems and methods are further characterized in that at least one of the oxygen enriched streams from the lower pressure column is an oxygen enriched condensing medium directed to the argon condenser.

Finally, the present invention may be characterized as a nitrogen liquefier configured to be integrated with an argon and nitrogen producing cryogenic air separation unit, the nitrogen liquefier comprising: (i) a gaseous nitrogen product stream produced from the cryogenic air separation unit and a gaseous nitrogen feed stream comprising between 1% and 10% of the gaseous nitrogen product stream by volume; (ii) a nitrogen feed compressor configured to receive the gaseous nitrogen feed stream via a first flow control valve and compress the gaseous nitrogen feed stream; (iii) a nitrogen recycle compressor configured to receive the compressed gaseous nitrogen feed stream from the nitrogen feed compressor or receive the gaseous nitrogen feed stream via a second bypass valve and further compress the received stream; (iv) a warm booster compressor configured to still further compress a first portion of the further compressed warm nitrogen stream to produce a cold nitrogen stream; (v) a cold booster compressor configured to further compress the cold nitrogen stream to produce a primary nitrogen liquefaction stream; (vi) a booster loaded warm turbine configured to expand a second portion of the further compressed warm nitrogen stream to produce a warm recycle stream; (vii) a booster loaded cold turbine configured to expand a recycle portion of the primary nitrogen liquefaction stream and produce a cold recycle stream; and (viii) a heat exchanger configured to cool the primary nitrogen liquefaction stream via indirect heat exchange with the warm recycle stream and cold recycle stream to produce a liquid nitrogen product stream, wherein the warm recycle stream and cold recycle stream are recycled back to the recycle compressor after exiting the heat exchanger.

BRIEF DESCRIPTION OF THE DRAWINGS

While the present invention concludes with claims distinctly pointing out the subject matter that Applicants regard as their invention, it is believed that the invention will be better understood when taken in connection with the accompanying drawings in which:

DETAILED DESCRIPTION

The presently disclosed system and method provides for cryogenic separation of air in a moderate pressure air separation unit with an integrated nitrogen liquefier characterized by a very high recovery of nitrogen, a high recovery of argon, and configured to efficiently operate in a no liquid nitrogen mode, a low liquid nitrogen mode and a high liquid nitrogen mode.

As discussed in more detail below, the disclosed cryogenic air separation unit comprises a three column arrangement and achieves the high argon and nitrogen recoveries by using a portion of high purity oxygen enriched stream taken from the lower pressure column or a lower purity oxygen enriched stream taken from the lower pressure column as the condensing medium in the argon condenser to condense the argon-rich stream. The oxygen rich boil-off from the argon condenser is then used as a purge gas to regenerate the adsorbent beds in the adsorption based pre-purifier unit. The disclosed air separation system and methods are further capable of limited oxygen production as well as a variable liquid nitrogen production as described in the paragraphs that follow.

Figure 1:
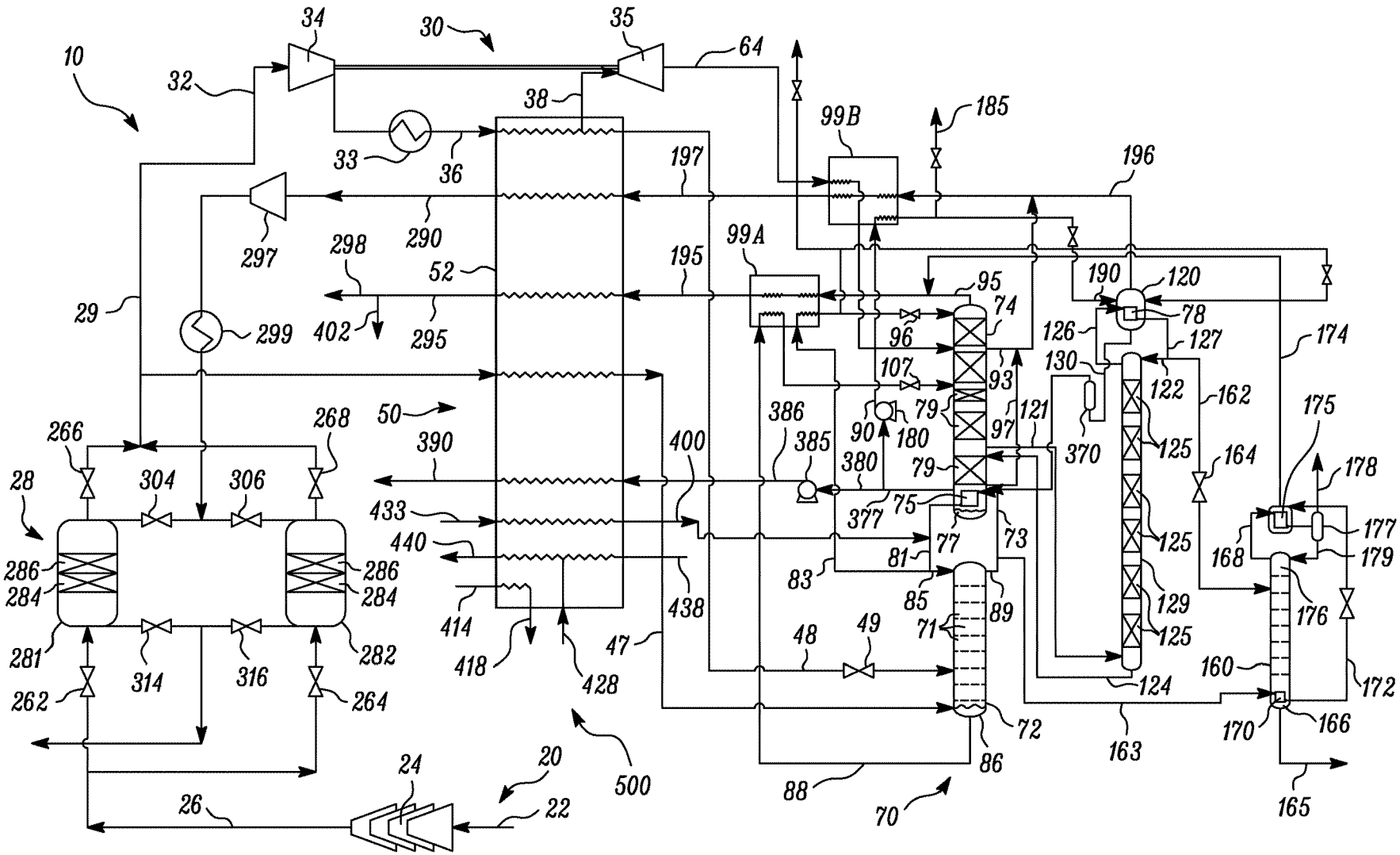
FIG. 1 is a schematic process flow diagram of a cryogenic air separation unit capable of operating at moderate pressure and having high nitrogen recovery and high argon recovery.

Recovery of Nitrogen, Argon and Oxygen in Moderate Pressure Air Separation Unit FIG. 1 shows a schematic illustration of an argon and nitrogen producing cryogenic air separation unit 10 having high nitrogen and argon recoveries.

In a broad sense, the depicted air separation units include a main feed air compression train or system 20, a turbine air circuit 30, an optional booster air circuit 40, a primary heat exchanger system 50, and a distillation column system 70. As used herein, the main feed air compression train, the turbine air circuit, and the booster air circuit, collectively comprise the 'warm-end' air compression circuit. Similarly, main heat exchanger, portions of the turbine based refrigeration circuit and portions of distillation column system are referred to as 'cold-end' equipment that are typically housed in insulated cold boxes.

In the main feed compression train shown in FIG. 1 the incoming feed air 22 is typically drawn through an air suction filter house (ASFH) and is compressed in a multistage, intercooled main air compressor arrangement 24 to a pressure that can be between about 6.5 bar(a) and about 11 bar(a). This main air compressor arrangement 24 may include integrally geared compressor stages or a direct drive compressor stages, arranged in series or in parallel. The compressed air stream 26 exiting the main air compressor arrangement 24 is fed to an aftercooler (not shown) with integral demister to remove the free moisture in the incoming feed air stream. The heat of compression from the final stages of compression for the main air compressor arrangement 24 is removed in aftercoolers by cooling the compressed feed air with cooling tower water. The condensate from this aftercooler as well as some of the intercoolers in the main air compression arrangement 24 is preferably piped to a condensate tank and used to supply water to other portions of the air separation plant.

The cool, dry compressed air stream 26 is then purified in a pre-purification unit 28 to remove high boiling contaminants from the cool, dry compressed air feed. A pre-purification unit 28, as is well known in the art, typically contains two beds of alumina and/or molecular sieve operating in accordance with a temperature swing adsorption cycle in which moisture and other impurities, such as carbon dioxide, water vapor and hydrocarbons, are adsorbed. While one of the beds is used for pre-purification of the cool, dry compressed air feed while the other bed is regenerated, preferably with a portion of the waste nitrogen from the air separation unit. The two beds switch service periodically. Particulates are removed from the compressed, pre-purified feed air in a dust filter disposed downstream of the pre-purification unit 28 to produce the compressed, purified air stream 29.

The compressed and purified air stream 29 is separated into oxygen-rich, nitrogen-rich, and argon-rich fractions in a plurality of distillation columns including a higher pressure column 72, a lower pressure column 74, and an argon column 129. Prior to such distillation however, the compressed and pre-purified air stream 29 is typically split into a plurality of feed air streams, which may include a boiler air stream and a turbine air stream 32. The boiler air stream may be further compressed in a booster compressor arrangement and subsequently cooled in aftercooler to form a boosted pressure air stream 360 which is then further cooled in the main heat exchanger 52. Cooling or partially cooling of the air streams in the main heat exchanger 52 is preferably accomplished by way of indirect heat exchange with the warming streams which include the oxygen streams 197, 386 as well as nitrogen streams 195 from the distillation column system 70 to produce cooled feed air streams.

The partially cooled feed air stream 38 is expanded in the turbine 35 to produce exhaust stream 64 that is directed to the lower pressure column 74. A portion of the refrigeration for the air separation unit 10 is also typically generated by the turbine 35. The fully cooled air stream 47 as well as the elevated pressure air stream are introduced into higher pressure column 72. Optionally, a minor portion of the air flowing in turbine air circuit 30 is not withdrawn in turbine feed stream 38. Optional boosted pressure stream 48 is withdrawn at the cold end of heat exchanger 52, fully or partially condensed, let down in pressure in valve 49 and fed to higher pressure column 72, several stages from the bottom. Stream 48 is utilized only when the magnitude of pumped oxygen stream 386 is sufficiently high.

The main heat exchanger 52 is preferably a brazed aluminum plate-fin type heat exchanger. Such heat exchangers are advantageous due to their compact design, high heat transfer rates and their ability to process multiple streams. They are manufactured as fully brazed and welded pressure vessels. For small air separation unit units, a heat exchanger comprising a single core may be sufficient. For larger air separation unit units handling higher flows, the heat exchanger may be constructed from several cores which must be connected in parallel or series.

The turbine based refrigeration circuits are often referred to as either a lower column turbine (LCT) arrangement or an upper column turbine (UCT) arrangement which are used to provide refrigeration to a two-column or three column cryogenic air distillation column systems. In the UCT arrangement shown in FIG. 1, the compressed, cooled turbine air stream 32 is preferably at a pressure in the range from between about 6 bar(a) to about 10.7 bar(a). The compressed, cooled turbine air stream 32 is directed or introduced into main or primary heat exchanger 52 in which it is partially cooled to a temperature in a range of between about 140 K and about 220 K to form a partially cooled, compressed turbine air stream 38 that is introduced into a turbine 35 to produce a cold exhaust stream 64 that is then introduced into the lower pressure column 74 of the distillation column system 70. The supplemental refrigeration created by the expansion of the stream 38 is thus imparted directly to the lower pressure column 72 thereby alleviating some of the cooling duty of the main heat exchanger 52. In some embodiments, the turbine 35 may be coupled with booster compressor 34 that is used to further compress the turbine air stream 32, either directly or by appropriate gearing.

While the turbine based refrigeration circuit illustrated in the FIG. 1 is shown as an upper column turbine (UCT) circuit where the turbine exhaust stream is directed to the lower pressure column, it is contemplated that the turbine based refrigeration circuit alternatively may be a lower column turbine (LCT) circuit or a partial lower column (PLCT) where the expanded exhaust stream is fed to the higher pressure column 72 of the distillation column system 70. Still further, turbine based refrigeration circuits may be some variant or combination of LCT arrangement, UCT arrangement and/or a warm recycle turbine (WRT) arrangement, generally known to those persons skilled in the art.

The aforementioned components of the incoming feed air stream, namely oxygen, nitrogen, and argon are separated within the distillation column system 70 that includes a higher pressure column 72, a lower pressure column 74, an argon column 129, a condenser-reboiler 75 and an argon condenser 78. The higher pressure column 72 typically operates in the range from between about 6 bar(a) to about 10 bar(a) whereas lower pressure column 74 operates at pressures between about 1.5 bar(a) to about 2.8 bar(a). The higher pressure column 72 and the lower pressure column 74 are preferably linked in a heat transfer relationship such that all or a portion of the nitrogen-rich vapor column overhead, extracted from proximate the top of higher pressure column 72 as stream 73, is condensed within a condenser-reboiler 75 located in the base of lower pressure column 74 against the oxygen-rich liquid column bottoms 77 residing in the bottom of the lower pressure column 74. The boiling of oxygen-rich liquid column bottoms 77 initiates the formation of an ascending vapor phase within lower pressure column 74. The condensation produces a liquid nitrogen containing stream 81 that is divided into a clean shelf reflux stream 83 that may be used to reflux the lower pressure column 74 to initiate the formation of descending liquid phase in such lower pressure column 74 and a nitrogen-rich stream 85 that refluxes the higher pressure column 72.

Cooled feed air stream 47 is preferably a vapor air stream slightly above its dew point, although it may be at or slightly below its dew point, that is fed into the higher pressure column for rectification resulting from mass transfer between an ascending vapor phase and a descending liquid phase that is initiated by reflux stream 85 occurring within a plurality of mass transfer contacting elements, illustrated as trays 71. This produces crude liquid oxygen column bottoms 86, also known as kettle liquid which is taken as stream 88, and the nitrogen-rich column overhead 89, taken as clean shelf liquid stream 83.

In the lower pressure column, the ascending vapor phase includes the boil-off from the condenser-reboiler as well as the exhaust stream 64 from the turbine 35 which is subcooled in subcooling unit 99B and introduced as a vapor stream at an intermediate location of the lower pressure column 72. The descending liquid is initiated by nitrogen reflux stream 83, which is sent to subcooling unit 99A, where it is subcooled and subsequently expanded in valve 96 prior to introduction to the lower pressure column 74 at a location proximate the top of the lower pressure column.

Lower pressure column 74 is also provided with a plurality of mass transfer contacting elements, that can be trays or structured packing or other known elements in the art of cryogenic air separation. The contacting elements in the lower pressure column 74 are illustrated as structured packing 79. The separation occurring within lower pressure column 74 produces an oxygen-rich liquid column bottoms 77 extracted as an oxygen enriched liquid stream 377 having an oxygen concentration of greater than 99.5%. The lower pressure column further produces a nitrogen-rich vapor column overhead that is extracted as a gaseous nitrogen product stream 95.

Oxygen enriched liquid stream 377 can be separated into a first oxygen enriched liquid stream 380 that is pumped in pump 385 and the resulting pumped oxygen stream 386 is directed to the main heat exchanger 52 where it is warmed to produce a high purity gaseous oxygen product stream 390. A second portion of the oxygen enriched liquid stream 377 is diverted as second oxygen enriched liquid stream 90. The second oxygen enriched liquid stream 90 is preferably pumped via pump 180 then subcooled in subcooling unit 99B via indirect heat exchange with the oxygen enriched waste stream 196 and then passed to argon condenser 78 where it is used to condense the argon-rich stream 126 taken from the overhead 123 of the argon column 129. As shown in FIG. 1, a portion of the subcooled second oxygen enriched liquid stream 90 or a portion of the first liquid oxygen stream may be taken as liquid oxygen product. However, the extraction of liquid oxygen product 185 as shown in FIG. 1 adversely impacts operating efficiencies of and recovery of argon and nitrogen from the air separation plant. Alternatively, some embodiments may extract a lower purity oxygen enriched stream (not shown) from the lower pressure column several stages above the condenser 75 in lieu of taking a portion of the high purity oxygen enriched stream as the condensing medium to condense the argon-rich stream.

The vaporized oxygen stream that is boiled off from the argon condenser 78 is an oxygen enriched waste stream 196 that is warmed within subcooler 99B. The warmed oxygen enriched waste stream 197 is directed to the main or primary heat exchanger and then used as a purge gas to regenerate the adsorption based prepurifier unit 28. Additionally, a waste nitrogen stream 93 may be extracted from the lower pressure column to control the purity of the gaseous nitrogen product stream 95. The waste nitrogen stream 93 is preferably combined with the oxygen enriched waste stream 196 upstream of subcooler 99B. Also, vapor waste oxygen stream 97 may be needed in some cases when more oxygen is available than is needed to operate argon condenser 78, typically when argon production is reduced.

Liquid stream 130 is withdrawn from argon condenser vessel 120, passed through gel trap 370 and returned to the base or near the base of lower pressure column 74. Gel trap 370 serves to remove carbon dioxide, nitrous oxide, and certain heavy hydrocarbons that might otherwise accumulate in the system. Alternatively, a small flow can be withdrawn via stream 130 as a drain from the system such that gel trap 140 is eliminated (not shown).

Preferably, the argon condenser shown in FIG. 1 is a downflow argon condenser. The downflow configuration makes the effective delta temperature ($\Delta T$) between the condensing stream and the boiling stream smaller. As indicated above, the smaller $\Delta T$ may result in reduced operating pressures within the argon column, lower pressure column, and higher pressure column, which translates to a reduction in power required to produce the various product streams as well as improved argon recovery. The use of the downflow argon condenser also enables a potential reduction in the number of column stages, particularly for the argon column. Use of an argon downflow condenser is also advantageous from a capital standpoint, in part, because pump 180 is already required in the presently disclosed air separation cycles. Also, since liquid stream 130 already provides a continuous liquid stream exiting the argon condenser shell which also provides the necessary wetting of the reboiling surfaces to prevent the argon condenser from 'boiling to dryness'.

Nitrogen product stream 95 is passed through subcooling unit 99A to subcool the nitrogen reflux stream 83 and kettle liquid stream 88 via indirect heat exchange. As indicated above, the subcooled nitrogen reflux stream 83 is expanded in valve 96 and introduced into an uppermost location of the lower pressure column 74 while the subcooled the kettle liquid stream 88 is expanded in valve 107 and introduced to an intermediate location of the lower pressure column 74. After passage through subcooling units 99A, the warmed nitrogen stream 195 is further warmed within main heat exchanger 52 to produce a warmed gaseous nitrogen product stream 295.

The flow of the first oxygen enriched liquid stream 380 may be up to about 20% of the total oxygen enriched streams exiting the system. The argon recovery of this arrangement is between about 75% and 96% which is greater than the prior art moderate pressure air separation systems. Although not shown, a stream of liquid nitrogen 400 taken from the nitrogen liquefier 500 described in more detail with reference to FIG. 2 or from an external source (not shown) may be combined with the second oxygen enriched liquid stream 90 and the combined stream used to condense the argon-rich stream 126 in the argon condenser 78, to enhance the argon recovery.

With liquid nitrogen add, the boiling refrigerant in the argon condenser is a mix of liquid oxygen and liquid nitrogen and will be generally colder than the boiling refrigerant disclosed in U.S. patent application Ser. Nos. 15/962205; 15/962245; 15/962297; and 15/962358. As a result, the distillation column system pressures may be naturally lower. In other words, the cryogenic air separation unit, and specifically the compressors and distillation column system, may be designed to take advantage of this lower operating pressure which would result in an overall power savings. Alternatively, if it is not desirable to design the compressors and distillation columns of cryogenic air separation unit for the required pressure ranges, the vaporized waste gas from the argon condenser may be back pressured at the warm end of the main heat exchanger. By doing this back pressuring, the boiling fluid temperature in the argon condenser is not altered and the distillation column system pressures will also remain the same. Employing this alternate back pressuring method would be the likely method of operation of the cryogenic air separation unit if the higher liquid oxygen production is expected to be infrequent or non-continuous.

Figure 2:
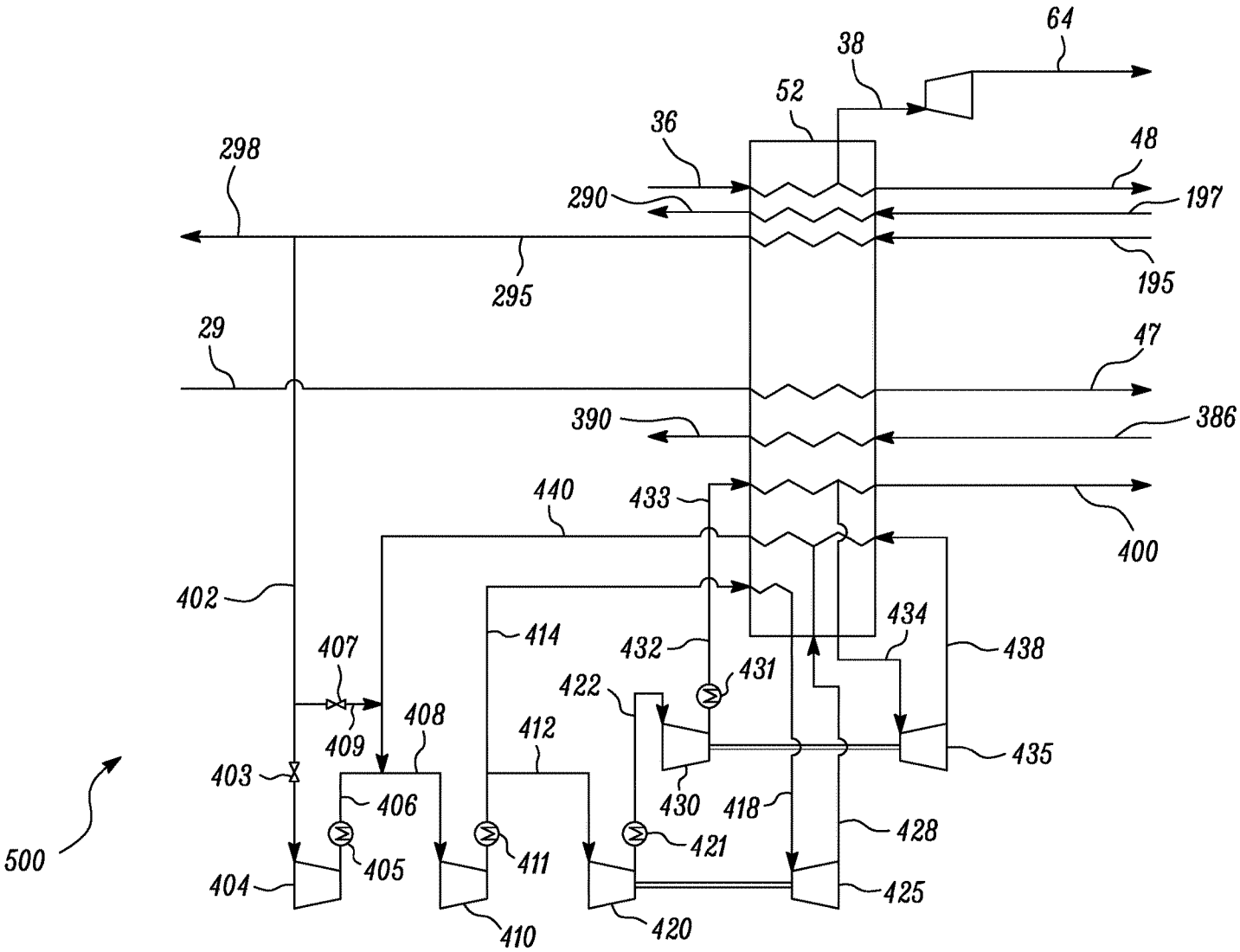
FIG. 2 is a partial schematic process flow diagram of a nitrogen liquefier configured to be integrated with the cryogenic air separation unit of FIG. 1.

Turning now to FIG. 2, the core of the improved cryogenic air separation unit is integrating a liquefaction cycle into the main heat exchange system and cold box of the gas-only argon and nitrogen cryogenic air separation unit. By doing so, the integrated liquefier can be a source of the liquid nitrogen product for re-tanking or back-up purposes and can also be used to replace any liquid nitrogen that is removed from the shelf transfer lines in the distillation column system to ensure the nitrogen reflux to the lower pressure distillation column is the same as it would be if the air separation cycle were not making any liquid nitrogen at all. This ensures that the distillation column system performance in terms of argon recovery and nitrogen recovery are roughly the same in the high liquid nitrogen mode, low liquid nitrogen mode, and no (nil) liquid nitrogen mode.

The integrated nitrogen liquefier 500 associated with above-described air separation unit is shown in more detail in FIG. 2. As seen therein, the nitrogen liquefier preferably includes a nitrogen feed compressor 404, a nitrogen recycle compressor 410, a warm booster compressor 420, a cold booster compressor 430, a booster loaded warm turbine 425, a booster loaded cold turbine 435, a heat exchanger 52, a plurality of aftercoolers, 405, 411, 421, 431, and at least two valves, including a first flow control valve 403 and a second bypass valve 407.

The nitrogen feed compressor 404 is configured to receive the gaseous nitrogen feed stream 402 via the first flow control valve 403 and compress the gaseous nitrogen feed stream to produce a compressed gaseous nitrogen feed stream 406. The nitrogen recycle compressor 410 is configured to receive either the compressed gaseous nitrogen feed stream 406 from the nitrogen feed compressor 404 or the diverted gaseous nitrogen feed stream 409 via the second bypass valve 407 and further compresses the received stream 408 to produce a further compressed warm nitrogen stream or discharge stream. The gaseous nitrogen feed stream 402 preferably comprises between about 1% and 10% of the gaseous nitrogen product stream 295 by volume, with the remainder of the gaseous nitrogen product stream 298 to be delivered to the end-user customer as gaseous nitrogen product. Nitrogen feed compressor 404 and nitrogen recycle compressor 410 will typically be multi-staged compressors, with inter-stage cooling.

The warm booster compressor 420 is disposed downstream of the nitrogen recycle compressor 410 and configured to still further compress a first portion 412 of the further compressed warm nitrogen stream to produce a further compressed cold nitrogen stream 422. The cold booster compressor 430 receives the cold nitrogen stream 422 and further compresses it to produce a primary nitrogen liquefaction stream 432 which is liquefied in the heat exchanger 52 to produce the liquid nitrogen stream 400 that is directed to the distillation column system of the air separation unit. Liquid nitrogen product is withdrawn after subcooler 99A.

The booster loaded warm turbine 425 is operatively coupled to and driven by the warm booster compressor 420. The booster loaded warm turbine 425 expands a second portion 414 of the further compressed warm nitrogen stream that has been partially cooled in heat exchanger 52 to produce a warm recycle stream 428. The booster loaded cold turbine 435 is operatively coupled to and driven by the cold booster compressor 430 and is configured to expand a diverted recycle portion 434 of the primary nitrogen liquefaction stream 432 that is partially cooled in the heat exchanger 52 to produce a cold recycle stream 438. The heat exchanger 52 is further arranged to cool the primary nitrogen liquefaction stream 432 via indirect heat exchange with the warm recycle stream 428 and cold recycle stream 438 to produce a liquid nitrogen product stream 400 while the warm recycle stream 428 and cold recycle stream 438 are returned back to the recycle compressor 410 as recycle stream 440 after exiting the warm end of the heat exchanger 52.

The present nitrogen liquefier 500 is configured to operate in at least three different operating modes, including a first nil liquid nitrogen mode wherein the first flow control valve 403 and the second bypass valve 407 are both oriented in a closed position such that no portion of the gaseous nitrogen product stream 295 is diverted to the nitrogen liquefier and no liquid nitrogen product stream is produced in the nitrogen liquefier. The second operating mode is a low liquid nitrogen mode wherein the first flow control valve 403 is oriented in a closed position and the second bypass valve 407 is oriented in an open position such that a portion of the gaseous nitrogen product stream 295 is diverted as a gaseous nitrogen feed stream 409 to the nitrogen recycle compressor 410 and bypasses the nitrogen feed compressor 404. The third operating mode is a high liquid nitrogen mode wherein the first flow control valve 403 is oriented in an open position and the second bypass valve 407 is oriented in a closed position such that a portion of the gaseous nitrogen product stream 295 is diverted as a gaseous nitrogen feed stream 402 to the nitrogen feed compressor 404. In the low liquid nitrogen operating mode the portion of the gaseous nitrogen product stream that is diverted to the nitrogen recycle compressor 410 is between about 1% and 5% of the gaseous nitrogen product stream 295, by volume. In the high liquid nitrogen operating mode, however, the portion of the gaseous nitrogen product stream 295 that is diverted to the nitrogen feed compressor 410 is between about 5% and 10% of the gaseous nitrogen product stream 295, by volume.

In the nil liquid nitrogen mode, the air separation unit can operate with the nitrogen liquefier completely turned off, however this may require some liquid nitrogen to be added from a liquid nitrogen storage tank to the distillation column system of the air separation unit to provide any refrigeration that may be required.

In the high liquid nitrogen mode, the gaseous nitrogen feed stream 402 is fed into the nitrogen feed compressor 404 where it is discharged at a pressure equal to the nitrogen liquefier recycle stream 440. The further compressed discharge stream 406 of the nitrogen feed compressor 404 is mixed with the recycle stream 440 to for stream 408 that is still further compressed to an intermediate pressure in the recycle compressor 410. The discharge stream from the recycle compressor 410 is split into two streams, including a first portion that is further compressed in series in both the warm booster compressor 420 and cold booster compressor 430 before being cooled in the heat exchanger 52. The second portion 414 of the discharge stream is cooled partway through the heat exchanger 52 and then expanded in the warm turbine 425. The exhaust stream 428 from the warm turbine is returned to the heat exchanger 52 at an intermediate location and mixed with the returning cold recycle stream 438.

In the low liquid nitrogen mode or liquid turndown mode, the gaseous nitrogen feed stream 402 is diverted via bypass valve 407 and directed to the nitrogen recycle compressor 410. In this low liquid nitrogen mode the turbomachinery is kept at roughly constant pressure ratio and actual volume flow. To accomplish this, the total head pressure of the nitrogen liquid product stream is reduced while keeping pressure ratios across the turbines generally constant until the recycle stream 440 enters the recycle compressor 410 at just above atmospheric pressure. In this low liquid nitrogen mode, the feed compressor is not needed since the gaseous nitrogen feed stream 402 is at higher pressure than the feed to the recycle compressor. In addition to turning down the total pressure in the nitrogen liquefier, the recycle flow rate is reduced until the volume flow through the compression equipment is equal to the volume flow in the high liquid nitrogen case. If feed compressor 404 is part of a combined service machine it may still have to be operated in a very low power consuming idle condition in this mode. For example, feed compressor 404 may be a single compressor, combined with recycle compressor 410.

When using the integrated nitrogen liquefier, there is little need for the UCT arrangement because the supplemental refrigeration is preferably provided by the integrated nitrogen liquefier. However, the UCT would preferably still be installed and the air separation unit could run in a true gas only mode with the liquefier turned off (i.e. nil liquid nitrogen mode), as discussed above.

From a heat exchanger perspective, the streams and/or heat exchange passages of both the nitrogen liquefier and the main heat exchanger for the air separation unit can be integrated into a single core, or in the case of larger air separation units all of the cores. Alternatively, the two heat exchange functions could be separated or divided amongst the cores in various possible configurations depending on the size of the air separation unit and the total number of heat exchange cores needed.

The is yet another hybrid operating mode that will referred to as hybrid Mode 4. In an effort to reduce operating costs (i.e. power costs) during gas only production of argon and nitrogen in the cryogenic air separation unit, the plant operator can alternate between running the air separation unit in the low liquid nitrogen mode (Mode 2) and the nil liquid nitrogen mode (Mode 1) where any required liquid nitrogen needed by the distillation column system is added from the liquid nitrogen tank or other source of liquid nitrogen. During this nil liquid nitrogen mode, the liquid nitrogen storage tank is being depleted and is periodically refilled by switching operating modes to the low liquid nitrogen mode. Employing this switching technique between nil liquid nitrogen mode and the low liquid nitrogen mode, the liquid nitrogen storage tank would have to be designed or sized with additional volume to allow for the switching between the different operating modes. While discrete operating modes are described here, it should be noted that this system is capable of a continuum of efficient liquid nitrogen production, from nil liquid nitrogen mode to low liquid nitrogen mode to high liquid nitrogen mode.

EXAMPLES

To demonstrate the utility of the present integrated liquefier, a computer model simulation was performed to compare the different operating modes of the nitrogen and argon producing cryogenic air separation unit with the integrated nitrogen liquefier as generally disclosed above. Various air separation unit operating parameters are compared to a baseline nitrogen and argon producing cryogenic air separation unit as generally shown and described in U.S. patent application Ser. No. 15/962,358.

In Table 1, the data from the computer model simulation is shown for three distinct operating modes of the nitrogen and argon producing cryogenic air separation unit, including: a no liquid nitrogen operating mode (Mode 1), referenced herein as the nil liquid nitrogen mode; a low liquid nitrogen mode (Mode 2); and a high liquid nitrogen mode (Mode 3). The operating pressures, temperatures and flows of the various streams and pressure ratios of the turbomachinery employed in the nitrogen liquefier depicted in FIG. 2 are tabulated for comparison purposes against the baseline air separation unit having no nitrogen liquefier.

For comparison purposes, the baseline system and all operating modes use similar incoming feed air conditions and with a pressure of the incoming compressed pre-purified air at about 116.1 psia. As seen in Table 1, each of the different operating modes produce a similar volume of gaseous nitrogen product, gaseous oxygen product compared to the baseline air separation unit, but the argon production is increased over the baseline air separation unit when operating in the low liquid nitrogen mode (Mode 2) and the high liquid nitrogen mode (Mode 3). The increase in argon production of over 2% in Mode 2 requires only a slight increase (e.g. 1.9%) in incoming air flow and corresponding increase in Main Air Compressor (MAC) power consumption of about 2% while the increase in argon production in Mode 3 is more significant at about 12.4% with a 11.7% increase in incoming air flow and a 12.0% increase in Main Air Compressor (MAC) power.

TABLE 1

| ASU Operating Parameter | Ref# | ASU w/o Integrated Liquefier (Baseline) | ASU with Integrated Liquefier (Mode 1) | ASU with Integrated Liquefier (Mode 2) | ASU with Integrated Liquefier (Mode 3) |
|---|---|---|---|---|---|
| Compressed, Pre-purified Air Flow (Normalized to X) | 29 | X | .992*X | 1.019*X | 1.118*X |
| Compressed, Pre-purified Air Pressure (psia) | 29 | 116.1 | 116.1 | 116.1 | 116.1 |
| Argon Product Flow (Normalized to X) | 165 | 0.009*X | 0.009*X | 0.0092*X | 0.010*X |
| Liquid Oxygen Flow (Normalized to X) | 185 | 0 | 0 | 0 | 82 |
| Gaseous Oxygen Flow (Normalized to X) | 390 | 0.0143*X | 0.0143*X | 0.0143*X | 0.0143*X |
| Gaseous Nitrogen Product Flow (Normalized to X) | 298 | 0.781*X | 0.781*X | 0.782*X | 0.782*X |
| Gaseous Nitrogen Product Pressure (psia) | 298 | 27.5 | 27.5 | 27.5 | 27.5 |
| Gaseous Nitrogen to Liquefier Flow (Normalized to X) | 402 | — | — | 750 | 4885 |
| Gaseous Nitrogen to Liquefier Pressure (psia) | 402 | — | — | 27.5 | 27.5 |
| Liquid Nitrogen Product Flow (Normalized to X) | 400 | 0.00011*X | 0.00011*X | 0.014*X | 0.0912*X |
| Liquid Nitrogen Product Pressure (psia) | 400 | — | — | 180 | 750 |
| Liquid Nitrogen Product Temperature (K) | 400 | — | — | 106.8 | 99.5 |
| Liquefier Feed Compressor Pressure Ratio | 404 | — | — | N/A | 2.94 |
| Liquefier Feed Compressor Output Pressure (psia) | 406 | — | — | N/A | 79.7 |
| Liquefier Recycle Compressor Pressure Ratio | 410 | — | — | 5.41 | 4.58 |
| Liquefier Recycle Compressor Output Pressure (psia) | 414 | — | — | 87.4 | 364.7 |
| Liquefier Warm Compressor Pressure Ratio | 420 | — | — | 1.35 | 1.46 |
| Liquefier Warm Compressor Output Pressure (psia) | 422 | — | — | 116.6 | 531.5 |
| Liquefier Warm Compressor Output Flow (Normalized to X) | 422 | — | — | 0.093*X | 0.389*X |
| Liquefier Cold Compressor Pressure Ratio | 430 | — | — | 1.61 | 1.43 |
| Liquefier Cold Compressor Output Pressure (psia) | 432 | — | — | 188 | 760 |
| Liquefier Cold Compressor Output Flow (Normalized to X) | 432 | — | — | 0.093*X | 0.389*X |
| Liquefier Warm Turbine Input Temp (K) | 418 | — | — | 257 | 257 |
| Liquefier Warm Turbine Pressure Ratio | 425 | — | — | 4.27 | 3.97 |
| Liquefier Warm Turbine Output Temp (K) | 428 | — | — | 182 | 178 |
| Liquefier Warm Turbine Output Pressure (psia) | 428 | — | — | 20 | 84 |
| Liquefier Warm Turbine Output Flow (Normalized to X) | 428 | — | — | 0.044*X | 0.244*X |
| Liquefier Cold Turbine Input Temp (K) | 434 | — | — | 179 | 175 |

TABLE 1-continued

| | | | | | |
|---|---|---|---|---|---|
| Liquefier Cold Turbine Pressure Ratio | 435 | — | — | 9.00 | 9.00 |
| Liquefier Cold Turbine Output Temp (K) | 438 | — | — | 103 | 96 |
| Liquefier Cold Turbine Output Pressure (psia) | 438 | — | — | 20 | 84 |
| Liquefier Cold Turbine Output Flow (Normalized to X) | 438 | — | — | 0.076*X | 0.298*X |
| | | | No | Min | High |
| Argon Recovery (%) | — | 96.92 | 97.75 | 97.60 | 97.77 |
| Nitrogen Recovery (%) | — | 100.00 | 100.00 | 99.99 | 100.00 |
| Main Air Compressor Power (Normalized to Z) | — | 0.619*Z | 0.615*Z | 0.632*Z | 0.693*Z |
| Booster Air Compressor Power (Normalized to Z) | — | 0.003*Z | 0.003*Z | — | — |
| MNC Compressor Power (Normalized to Z) | — | 0.378*Z | 0.376*Z | 0.377*Z | 0.377*Z |
| Integrated Liquefier Power (Normalized to Z) | — | — | — | 0.067*Z | 0.319*Z |
| Total Compressor Power (Normalized to Z) | — | Z | .9945*Z | 1.07*Z | 1.39*Z |

More importantly, and as expected, the liquid nitrogen production is greatly improved when operating in the low liquid nitrogen mode (Mode 2) and the high liquid nitrogen mode (Mode 3). Specifically, in Mode 2 which is the lower pressure low liquid nitrogen mode (i.e. liquid nitrogen turndown mode) with the first flow control valve closed (see valve 403 in FIG. 2), the second bypass valve open (see valve 407 in FIG. 2) and the gaseous nitrogen feed stream reduced in pressure from about 27.5 psia (see stream 402 in FIG. 2) to about 16.5 psia (see stream 409 in FIG. 2), the liquid nitrogen product make is about 1.4% of the incoming air flow at a pressure of about 180 psia while the nitrogen liquefier consumes just over 6% of the total power consumed. In contrast, operating the air separation in Mode 3 which is the higher pressure, high liquid nitrogen operating mode with the first flow control valve opened (see valve 403 in FIG. 2), the second bypass valve closed (see valve 407 in FIG. 2) and the pressure of the gaseous nitrogen feed stream at about 27.5 psia (see stream 404 in FIG. 2), the liquid nitrogen product make is about 8.1% of the incoming air flow at a pressure of about 750 psia while the nitrogen liquefier consumes about 22.9% of the total power consumed.

For sake of comparison, operating Mode 1 shown in Table 1 and Table 2 is the nil liquid nitrogen operating mode with both the first flow control valve (see valve 403 in FIG. 2) and the second bypass valve (see valve 407 in FIG. 2) closed. In such operating mode, nominal amounts of liquid nitrogen may be extracted from the air separation unit as a small portion of the subcooled shelf transfer nitrogen stream. Also, as indicated above, the Baseline mode represents operation of the nitrogen and argon producing cryogenic air separation unit as generally shown and described in U.S. patent application Ser. No. 15/962,358.

Turning now to Table 2, a further comparison of the respective product makes and power consumption is shown between the Mode 1 and Mode 2 operating modes as described above with a different contemplated operating Mode 4, that switches between Mode 1 and operating Mode 2 over time depending on the local liquid nitrogen demand and the cost of power. For example, when utility power costs are high and/or the demand for liquid nitrogen is low, the operator may elect to operate in Mode 1 (i.e. nil liquid nitrogen operating mode) whereas when utility power costs are lower and/or some demand for liquid nitrogen exists, the operator may elect to operate the air separation unit in Mode 2 (i.e. liquid nitrogen turndown mode). Mode 4 represents a shared operating mode or an average of the Mode 1 and Mode 2 operations.

TABLE 2

| ASU Operating Parameter | Ref# | ASU with Integrated Liquefier (Mode 1) | ASU with Integrated Liquefier (Mode 2) | ASU with Integrated Liquefier (Mode 4) |
|---|---|---|---|---|
| Compressed, Pre-purified Air Flow (Normalized to X) | 29 | .992*X | 1.019*X | 1.00*X |
| Argon Product Flow (Normalized to X) | 165 | 0.0090*X | 0.0092*X | 0.0091*X |
| Liquid Oxygen Flow (Normalized to X) | 185 | 0 | 0 | 0 |
| Gaseous Oxygen Flow (Normalized to X) | 390 | 0.0143*X | 0.0143*X | 0.0143*X |
| Gaseous Nitrogen Product Flow (Normalized to X) | 298 | 0.781*X | 0.782*X | 0.781*X |
| Liquid Nitrogen Product Flow (Normalized to X) | 400 | 0.00011*X | 0.014*X | 0.0044*X |
| | | No | Min | High |
| Argon Recovery (%) | — | 97.75 | 97.60 | 97.70 |
| Nitrogen Recovery (%) | — | 100.00 | 99.99 | 100.00 |
| Main Air Compressor Power (Normalized to Z) | — | 0.615*Z | 0.632*Z | 0.620*Z |
| Booster Air Compressor Power (Normalized to Z) | — | 0.003*Z | — | 0.002*Z |
| MNC Compressor Power (Normalized to Z) | — | 0.376*Z | 0.377*Z | 0.377*Z |
| Integrated Liquefier Power (Normalized to Z) | — | — | 0.067*Z | 0.021*Z |
| Total Compressor Power (Normalized to Z) | — | .995*Z | 1.07*Z | 1.02*Z |

As evidenced by the data produced in the computer model simulations and shown in the Tables, the above-described argon and nitrogen producing air separation unit can operate in a gas only product slate mode or as a high liquid nitrogen mode (i.e. LIN sprint mode or re-tanking mode) or even in a low liquid nitrogen mode without a loss of performance in the argon recovery and nitrogen recovery from the distillation column system in any of the three modes.

While the present invention has been described with reference to a preferred embodiment or embodiments, it is understood that numerous additions, changes and omissions can be made without departing from the spirit and scope of the present invention as set forth in the appended claims.

What is claimed is:

1. An air separation unit comprising:

a main air compression system configured for receiving a stream of incoming feed air and producing a compressed air stream;

an adsorption based pre-purifier unit configured for removing water vapor, carbon dioxide, nitrous oxide, and hydrocarbons from the compressed air stream and producing a compressed and purified air stream;

a main heat exchange system configured to cool the compressed and purified air stream to temperatures suitable for fractional distillation;

a distillation column system having a higher pressure column and a lower pressure column linked in a heat transfer relationship via a condenser-reboiler, the distillation column system further includes an argon column arrangement operatively coupled with the lower pressure column, the argon column arrangement having at least one argon column and an argon condenser, the distillation column system configured for receiving the cooled, compressed and purified air stream and produce at least two or more oxygen enriched streams from the lower pressure column; an argon product stream, and a gaseous nitrogen product stream;

wherein at least one of the oxygen enriched streams from the lower pressure column is an oxygen enriched condensing medium directed to the argon condenser; and a nitrogen liquefier comprising a nitrogen feed compressor; a nitrogen recycle compressor; a warm booster compressor, a booster loaded warm turbine, a cold booster compressor, and a booster loaded cold turbine, a flow control valve disposed upstream of the nitrogen feed compressor and a bypass valve configured for diverting a gaseous nitrogen feed stream to the nitrogen recycle compressor;

wherein the nitrogen liquefier is integrated with the main heat exchange system and distillation column system and wherein the nitrogen liquefier is arranged or configured to receive a portion of the gaseous nitrogen product stream and produce a liquid nitrogen stream;

wherein the nitrogen liquefier is configured to operate in three modes, including: (i) a first nil liquid nitrogen mode where no portion of the gaseous nitrogen product stream is diverted to the nitrogen liquefier and no liquid nitrogen product stream is produced in the nitrogen liquefier; (ii) a second low liquid nitrogen mode wherein a portion of the gaseous nitrogen product stream is diverted as the gaseous nitrogen feed stream to the nitrogen liquefier, the gaseous nitrogen feed stream bypasses the nitrogen feed compressor and is diverted to the nitrogen recycle compressor; and (iii) a third high liquid nitrogen mode wherein a portion of the gaseous nitrogen product stream is diverted as the gaseous nitrogen feed stream to the nitrogen feed compressor of the nitrogen liquefier.

2. The air separation unit of claim 1, wherein the nitrogen liquefier further comprises wherein the bypass valve is an expansion valve configured for reducing the pressure of the gaseous nitrogen feed stream diverted to the nitrogen recycle compressor.

3. The air separation unit of claim 1, wherein in the first nil liquid nitrogen mode, the flow control valve and the bypass valve are both in a closed position such that none of the gaseous nitrogen product stream is diverted to the nitrogen liquefier.

4. The air separation unit of claim 1, wherein in the second low liquid nitrogen mode, the flow control valve is in a closed position and the bypass valve is in an open position such that a portion of the gaseous nitrogen product stream is diverted to the nitrogen recycle compressor of the nitrogen liquefier.

5. The air separation unit of claim 4, wherein the portion of the gaseous nitrogen product stream is diverted to the nitrogen recycle compressor portion is between 1% and 5% of the gaseous nitrogen product stream, by volumetric flow.

6. The air separation unit of claim 1, wherein in the third high liquid nitrogen mode, the flow control valve is in an open position and the bypass valve is in a closed position such than a portion of the gaseous nitrogen product stream is diverted to the nitrogen feed compressor of the nitrogen liquefier.

7. The air separation unit of claim 6, wherein the portion of the gaseous nitrogen product stream diverted to the nitrogen liquefier is between 5% and 10% of the gaseous nitrogen product stream.

8. The air separation unit of claim 1, wherein:

the argon column is configured to receive an argon-oxygen enriched stream from the lower pressure column and to produce a third oxygen enriched stream that is returned to or released into the lower pressure column and an argon-enriched overhead that is directed to the argon condenser; and the argon condenser is configured to condense the argon-enriched overhead against the oxygen enriched condensing medium taken from the lower pressure column to produce a crude argon stream, an argon reflux stream and an oxygen enriched waste stream.

9. The air separation unit of claim 8, wherein the argon condenser is configured to condense the argon-enriched overhead against a mixture of the oxygen enriched condensing medium taken from the lower pressure column and a source of liquid nitrogen to produce the crude argon stream, the argon reflux stream and the oxygen enriched waste stream.

10. The air separation unit of claim 9, wherein the source of liquid nitrogen is a portion of the liquid nitrogen product stream taken from a nitrogen subcooler.

11. The air separation unit of claim 8, wherein the oxygen enriched waste stream is warmed in the main heat exchange system and used to regenerate the adsorption based pre-purification unit.

12. The air separation unit of claim 11, wherein the oxygen enriched waste stream is further compressed upstream of the adsorption based pre-purification unit.

* * * * *